US010323833B2

(12) United States Patent
Hall et al.

(10) Patent No.: US 10,323,833 B2
(45) Date of Patent: Jun. 18, 2019

(54) LIGHT BULB WITH A ROTATING BASE

(71) Applicants: David R. Hall, Provo, UT (US); Hyrum Malone, Provo, UT (US); Justin Robinson, Provo, UT (US)

(72) Inventors: David R. Hall, Provo, UT (US); Hyrum Malone, Provo, UT (US); Justin Robinson, Provo, UT (US)

(73) Assignee: Hall Labs LLC, Provo, UT (US)

( * ) Notice: Subject to any disclaimer, the term of this patent is extended or adjusted under 35 U.S.C. 154(b) by 154 days.

(21) Appl. No.: 15/290,531

(22) Filed: Oct. 11, 2016

(65) Prior Publication Data

US 2018/0100642 A1 Apr. 12, 2018

(51) Int. Cl.

| | |
|---|---|
| ***F21V 21/30*** | (2006.01) |
| ***F21V 19/00*** | (2006.01) |
| *F21V 11/08* | (2006.01) |
| *F21V 23/00* | (2015.01) |
| *F21V 17/12* | (2006.01) |
| *F21S 9/02* | (2006.01) |
| *F21V 7/06* | (2006.01) |
| *F21Y 115/10* | (2016.01) |
| *F21Y 111/00* | (2016.01) |

(52) U.S. Cl.

CPC ..... *F21V 21/30* (2013.01); *F21V 19/006* (2013.01); *F21S 9/02* (2013.01); *F21V 7/06* (2013.01); *F21V 11/08* (2013.01); *F21V 17/12* (2013.01); *F21V 19/007* (2013.01); *F21V 23/003* (2013.01); *F21Y 2111/00* (2013.01); *F21Y 2115/10* (2016.08)

(58) Field of Classification Search

CPC ..... F21V 21/30; F21V 19/006; F21V 7/06; F21V 11/08; F21V 17/12; F21V 19/007; F21V 23/003; F21Y 2115/10; F21Y 2111/00; F21S 9/02

USPC ..... 362/235

See application file for complete search history.

(56) References Cited

U.S. PATENT DOCUMENTS

2012/0026732 A1* 2/2012 Fricke ..... F21V 14/02 362/231

2014/0218923 A1* 8/2014 Chi ..... F21K 9/23 362/249.03

* cited by examiner

*Primary Examiner* — Anh T Mai
*Assistant Examiner* — Jessica M Apenteng

(57) ABSTRACT

A light bulb is disclosed herein, which in general, includes a light transmitting bulb portion and a base portion. The light transmitting bulb portion includes a first gear and an aperture. The base portion includes a second gear. The first gear is rotated independently of the second gear to direct light produced by the light bulb in a direction defined by a rotational position of the light transmitting bulb portion.

19 Claims, 10 Drawing Sheets

LIGHT BULB WITH A ROTATING BASE

BACKGROUND

Field of the Invention

The present invention relates to light bulbs which rotate to direct light.

SUMMARY

This invention has been developed in response to the present state of the art and, in particular, in response to the problems and needs in the art that have not yet been fully solved by currently available systems and methods. Accordingly, a light bulb which rotates to direct light has been developed. Features and advantages of different embodiments of the invention will become more fully apparent from the following description and appended claims, or may be learned by practice of the invention as set forth hereinafter.

A light bulb is disclosed herein, which in general, includes a light transmitting bulb portion and a base portion. The light transmitting bulb portion includes a first gear and an aperture. The base portion includes a second gear. The first gear is rotated independently of the second gear to direct light produced by the light bulb in a direction defined by a rotational position of the light transmitting bulb portion.

The base portion may include an Edison screw. The light transmitting bulb portion may rotate synchronously with the base portion in a clockwise direction until a predetermined torque is reached. The light transmitting bulb portion may rotate synchronously with the base portion in a counterclockwise direction before and after a predetermined torque is reached. The light transmitting bulb portion may further include a light reflecting portion on an inner surface of the light transmitting bulb portion. The light reflecting portion may be substantially parabolic in shape. The substantially parabolic shape may form a parabolic reflector which may include more than 40% of an inner surface of the light transmitting bulb portion.

The light bulb may include one or more light sources. The one or more light sources may be LED (light emitting diode) light sources. Light transmitted from the one or more LED light sources may be transmitted through the light transmitting bulb portion of the light bulb when the light bulb is "on". The light transmitting bulb portion may be pulled away from the base portion to disengage the first gear from the second gear. The light transmitting bulb portion may be rotatable while the light bulb is turned "on" without rotating the one or more LED light sources. The LED light sources may transmit light through the aperture in the light transmitting bulb portion. The aperture may be formed by a size of the light reflecting portion. The light bulb may further include a controller and a power supply operably connected to the one or more light sources. Additionally, the controller may include a processor, memory, and one or more transceivers. The light bulb may further include a spring. The spring may push the light transmitting bulb portion toward the base portion.

The first gear and the second gear may interlock to screw the base portion into a light socket. Also, the first gear and the second gear may interlock to unscrew the base portion out of a light socket.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, as claimed, but is merely representative of certain examples of presently contemplated embodiments in accordance with the invention. The presently described embodiments will be best understood by reference to the drawings, wherein like parts are designated by like numerals throughout.

A detailed description of the claimed invention is provided below by example, with reference to embodiments in the appended figures. Those of skill in the art will recognize that the components of the invention as described by example in the figures below could be arranged and designed in a wide variety of different configurations. Thus, the detailed description of the embodiments in the figures is merely representative of embodiments of the invention, and is not intended to limit the scope of the invention as claimed.

In some instances, features represented by numerical values, such as dimensions, mass, quantities, and other properties that can be represented numerically, are stated as approximations. Unless otherwise stated, an approximate value means "correct to within 50% of the stated value." Thus, a length of approximately 1 inch should be read "1 inch+/−0.5 inch."

Aspects of the present invention are described herein with reference to flowchart illustrations and/or block diagrams of methods, apparatus (systems), and computer program products according to embodiments of the invention. Those of skill in the art will understand that each block of the flowchart illustrations and/or block diagrams, and combinations of blocks in the flowchart illustrations and/or block diagrams, may be implemented by computer readable program instructions. Additionally, those of skill in the art will recognize that the system blocks and method flowcharts, though depicted in a certain order, may be organized in a different order and/or configuration without departing from the substance of the claimed invention.

Figure 1:
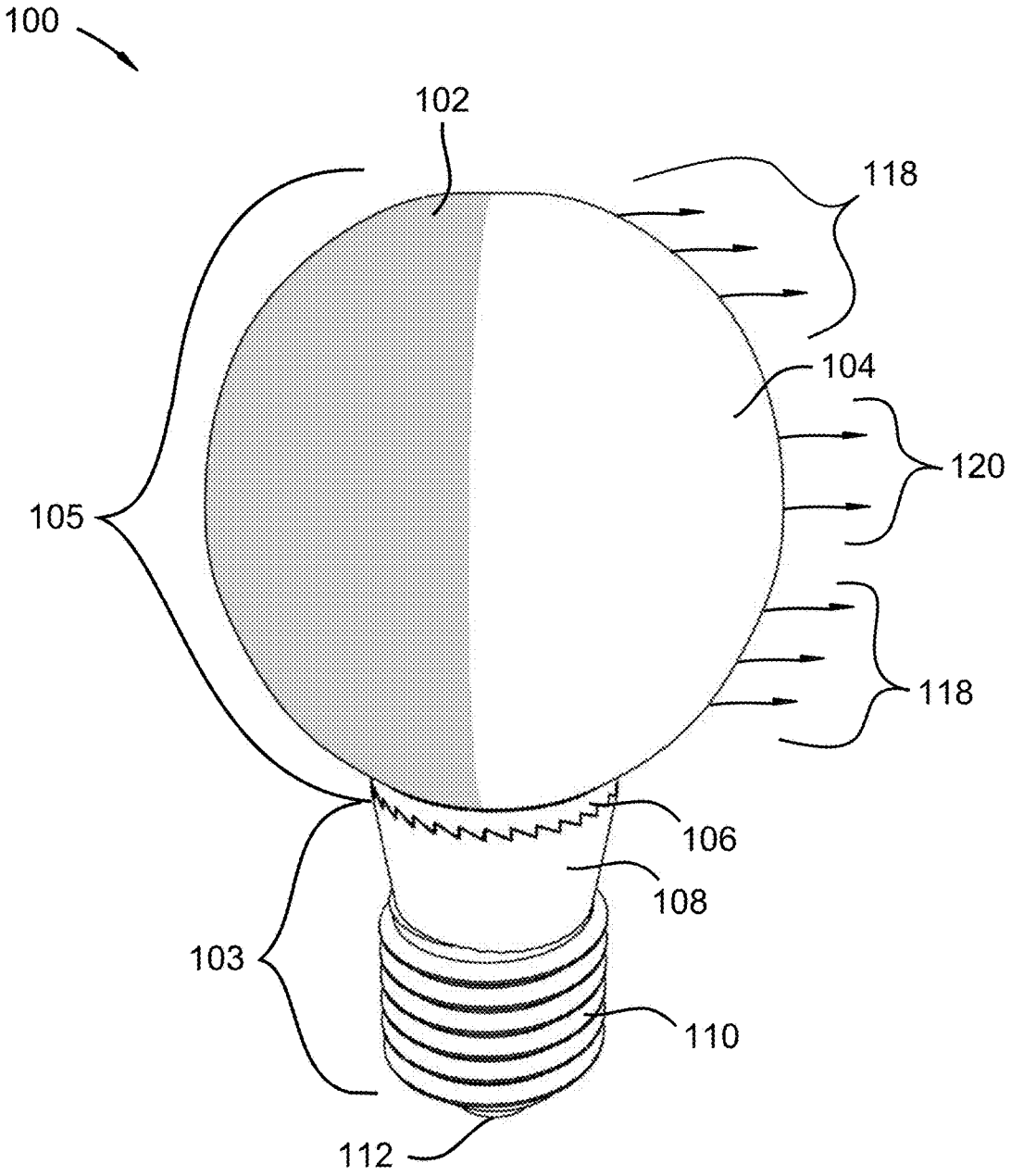
FIG. 1 depicts a light bulb in accordance with an embodiment of the invention.

FIG. 1 depicts a light bulb in accordance with an embodiment of the invention. Light bulb 100 includes light transmitting bulb portion 105 and base portion 103. Light transmitting bulb portion 105 includes first gear 106 and aperture 104 (aperture meaning a space through which light passes). Base portion 103 includes second gear 108. First gear 106 is rotated independently of second gear 108 to direct light produced by light bulb 100 in a direction defined by a rotational position of light transmitting bulb portion 105.

Aperture 104 may be made of any of a variety of materials, including glass, fused silica, tempered glass, aluminum oxynitride, polycarbonate, polyethylene terephthalate (PET), polyvinyl butyral (PVB), etc. Kaolin may also be deposited on an inner surface of aperture 104. Light transmitting bulb portion 105 may include vents to allow for circulation of air inside and outside of light transmitting bulb portion 105. Aperture 104 may be any of a variety of shapes, including spherical, ovoidal, elliptically paraboloidal, polyhedral, etc. light transmitting bulb portion 105 may include a masked portion 102.

First gear 106 may have teeth which mesh with teeth of second gear 108. First gear 106 may be concentric with second gear 108, and a certain magnitude of torque may be required to act upon first gear 106 before first gear 106 may move independently of second gear 108. In some embodiments, for example, base portion 103 may include cap 110, wherein cap 110 may be an Edison screw, which may require 3 lbf ft of torque to be applied to light bulb 100 about a centric axis of cap 110 to install light bulb 110 within a corresponding light bulb socket. In some further embodiments, if more than 3 lbf ft of torque is applied to light transmitting bulb portion 105 in a clockwise direction, first gear 106 may move independently of second gear 108 such that base portion 103 may not be over-torqued, thus avoiding risks of breaking light bulb 100. If torque may be applied to light transmitting bulb portion 105 in a counterclockwise direction, first gear 106 may couple with second gear 108 such that base portion 103 may be removed from a light bulb socket. In other words, light transmitting bulb portion 105 may rotate synchronously with base portion 103 in a clockwise direction until a predetermined torque is reached. Light transmitting bulb portion 102 may also rotate synchronously with base portion 103 in a counter-clockwise direction before and after a predetermined torque is reached.

Light rays 118 are a result of an inner reflection of masked portion 102. Masked portion 102 provides a reflective inner surface and a masked outer surface. Light transmitting bulb portion 105 transmits light waves 118 and 120 through a light transparent aperture 104. Light ray 120 are rays not reflected from an inner reflective surface but directly transmitted from the light source through aperture 104. When bulb portion 105 reaches a predetermined torque, bulb portion 105 may be rotated in a clock-wise direction allowing aperture 104 and light rays 118 and 120 to be directed in any rotational direction within a 360-degree radius around light bulb 100.

The predetermined torque may be selected based upon material strengths of materials within light bulb 100, type of light bulb cap, and necessary torque values to secure base portion 103 to a light bulb socket. In some additional embodiments, cap 110 of base portion 103 may be a bayonet cap.

First gear 106 and second gear 108 may interlock to screw base portion 103 in a light socket. First gear 106 and second gear 108 may also interlock to unscrew base portion 103 out of a light socket.

Figure 2:
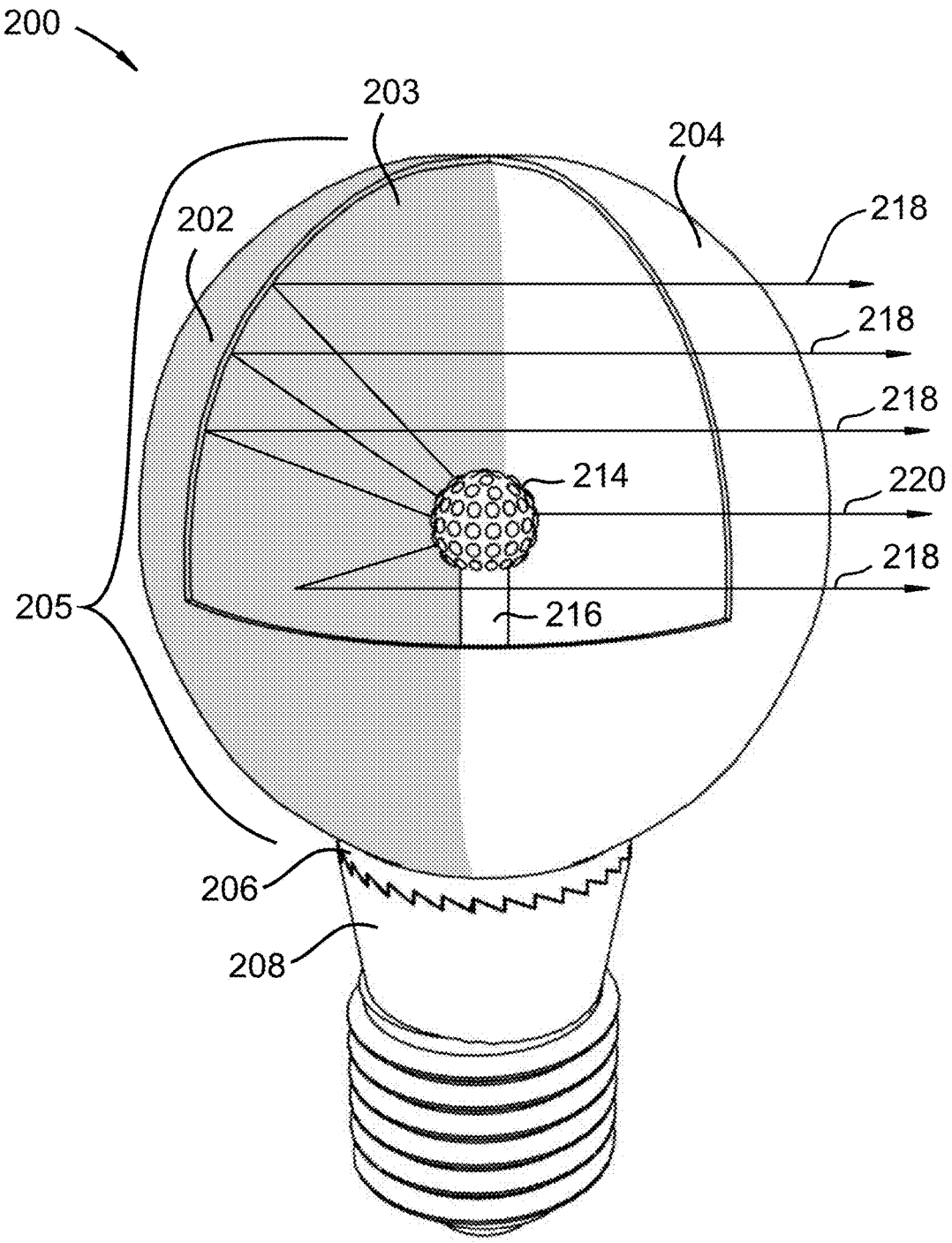
FIG. 2 depicts a light bulb with an exposed light source.

FIG. 2 depicts a light bulb with an exposed light source. Light bulb 200 may include light transmitting bulb portion 205. Light transmitting bulb portion 205 may include aperture 204 and light reflecting portion 203. Light reflecting portion 203 may be on an inner surface of light transmitting bulb portion 205. Light reflecting portion 203 may reflect light from one or more light sources 214 such that light emitted from light sources 214 may be directed toward and out of aperture 204. Light reflecting portion 203 may be substantially parabolic in shape, such that multiple rays of reflected light 218 reflected by light reflecting portion 203 may be substantially parallel to each other and in a general direction toward aperture 204. Aperture 204 may subsequently transmit reflected light 218 and non-reflected light 220 to an environment outside of light bulb 200. In some embodiments, the substantially parabolic shape forms a parabolic reflector which includes more than 40% of an inner surface of light transmitting bulb portion 205. In some embodiments, light transmitting bulb portion 205 may include masked portion 202 including to an outside surface of light transmitting bulb portion 205 which may be adjacent and concentric with light reflecting portion 203. In addition, aperture 204 may also transmit non-reflected light 220 which may be emitted directly from light sources 214.

Light sources 214 may be light emitting diode (LED) light sources which transmit light through aperture 204 in light transmitting bulb portion 205. LED light sources 214 may be RGB LEDs. LED light sources 214 may be dedicated color LEDs. Hollow tube 216 provides a path for light source wiring to reach a controller within a base portion of the light bulb. Tube 216 provides a support for light sources 214 and provides a non-movable connection to the base portion of the light. The light transmitting bulb portion 205 rotates around tube 216 and light sources 214.

Light transmitting bulb portion 205 may additionally include first gear 206 which may mesh with second gear 208. Aperture 204 may change its angular position with respect to a light bulb socket as first gear 206 is rotated with respect to second gear 208.

Figure 3:
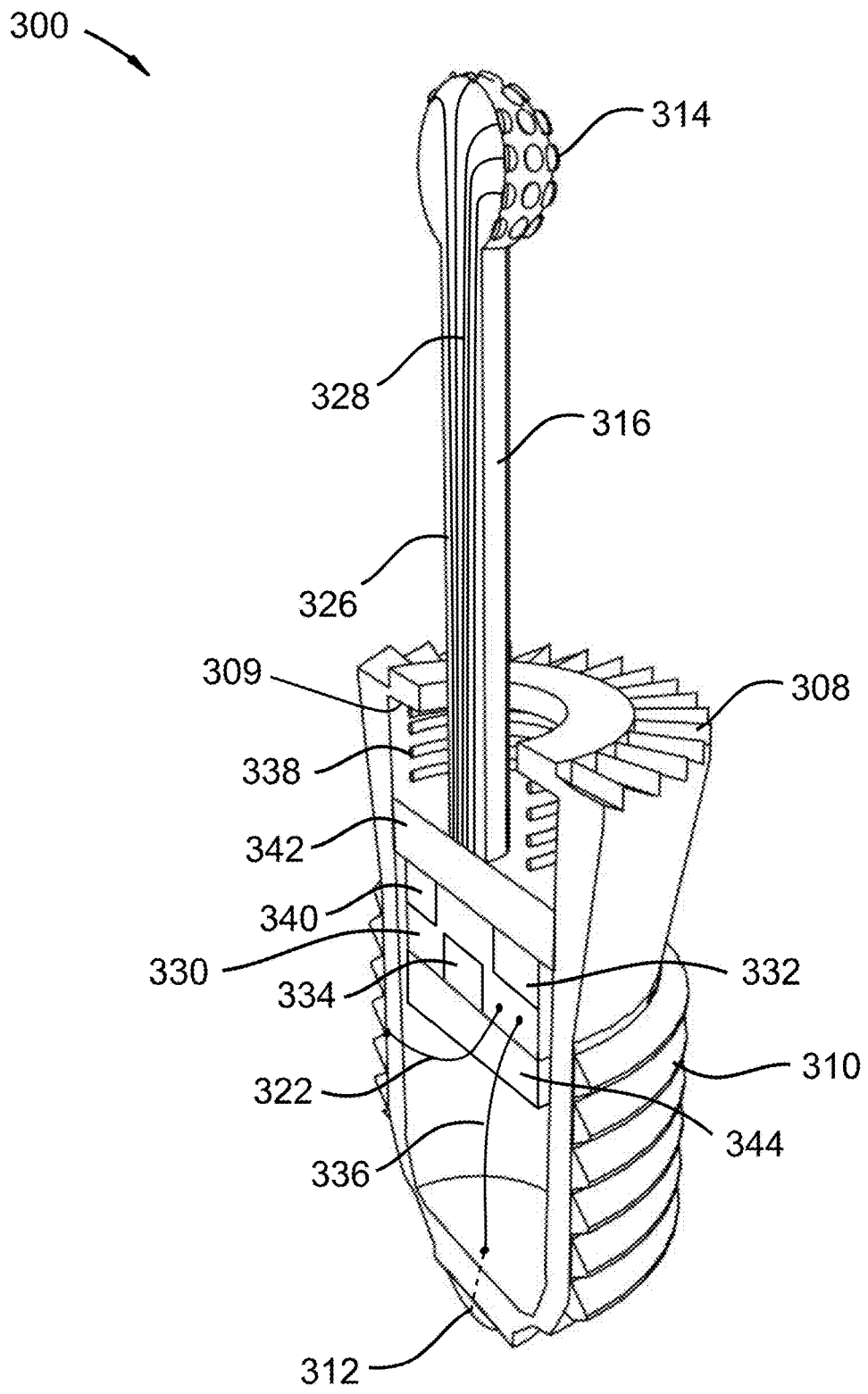
FIG. 3 depicts a perspective cross-section of a light bulb base portion.

FIG. 3 depicts a perspective cross-section of a light bulb base portion. Light bulb base portion 300 of a light bulb may include support tube 316 and one or more light sources 314. One or more light sources 314 may be induction light sources, LED light sources, or ionization light sources. Light sources 314 may be any of a variety of light sources, including incandescent light bulbs, fluorescent light bulbs, arc lamps, vapor lamps, etc.

In some embodiments, one or more light sources 314 may be LED light sources. Light transmitted from one or more LED light sources may be transmitted through an aperture of a light transmitting bulb portion (described above with reference to FIG. 1) of the light bulb when the light bulb is "on". Light bulb base portion 300 may further include controller 330 and a power supply operably connected to one or more light sources 314. The power supply may be connect to light sources 314 via controller 330, power wire 336, and power wire 322, wherein power wire 336 may be connect to a live electrical wire via electrical contact 312 and power wire 322 may connect to an electrical ground via metallic cap 310. Controller 330 may include processor 340, memory 334, and one or more transceivers 332. Transceivers 332 may include Bluetooth, SureFi, WiFi, and other known home automation technologies. Transceivers 332 may enable light bulb base portion 300 to connect with remote databases, local user devices, or Internet enabled devices. Memory 334 may include programming necessary to communicate wirelessly with remote devices and to control light sources 314 of light base 300 based on programming and/or remote user devices. Controller 330 may include circuitry to regulate power output to light sources 314. Support tube 316 may include light source wires 328 for each of light sources 314. Inner area 326 of support tube 316 may enclose material to separate light source wires 328 from each other; this material may be foam, Styrofoam, any of a variety of ferrous or non-ferrous metals with coatings around light source wires 328, glass, fused silica, tempered glass, aluminum oxynitride, polycarbonate, polyethylene terephthalate (PET), polyvinyl butyral (PVB), etc.

Light bulb base portion 300 may include spring 338. Spring 338 may bias a second spring push surface (not shown) such as to maintain a force between a gear or other surface, such as an elastomeric material, and gear 308. Spring 338 may maintain said force on first spring push surface 309 as well. A stationary portion 342 may provide a fixed connection between tube 316 and a body of the base portion as shown in FIG. 3. Stationary portion 342 may also provide a mounting surface for a circuit board, processor 340, controller 330 and battery 344 below the stationary portion 342. Battery 344 may be a rechargeable battery.

Figure 4:
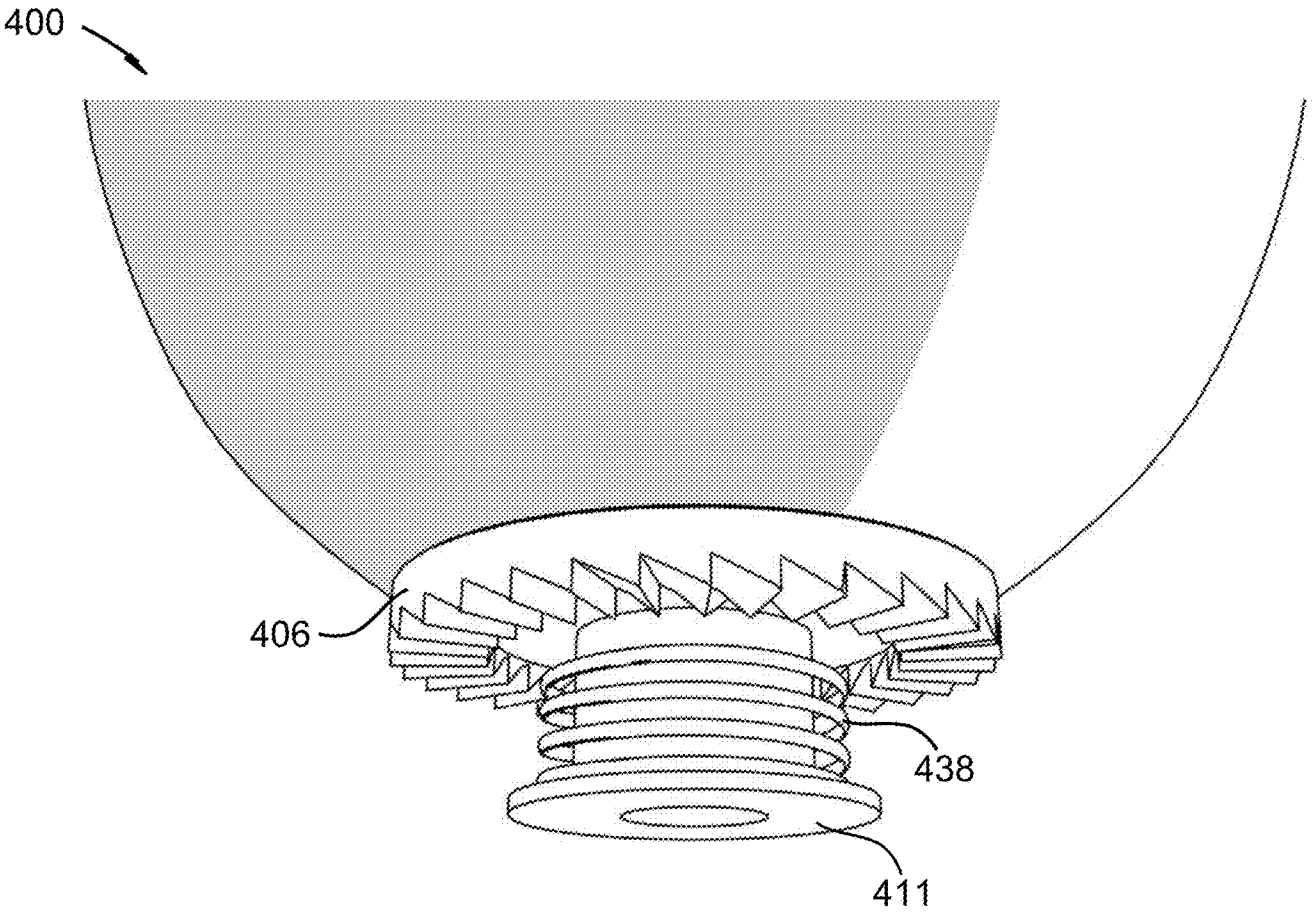
FIG. 4 depicts part of a perspective view of a bottom of a light transmitting bulb portion of a light bulb.

FIG. 4 depicts part of a perspective view of a bottom of a light transmitting bulb portion of a light bulb. Light transmitting bulb portion 400 may include first gear 406, spring 438, and second spring push surface 411. Spring 438 may develop a force against second spring push surface 411 as well as a force against a first spring push surface (depicted above in FIG. 3). These developed forces may maintain equilibrium and maintain a relative distance between first gear 406 and a second gear (depicted in FIG. 1).

Figure 5:
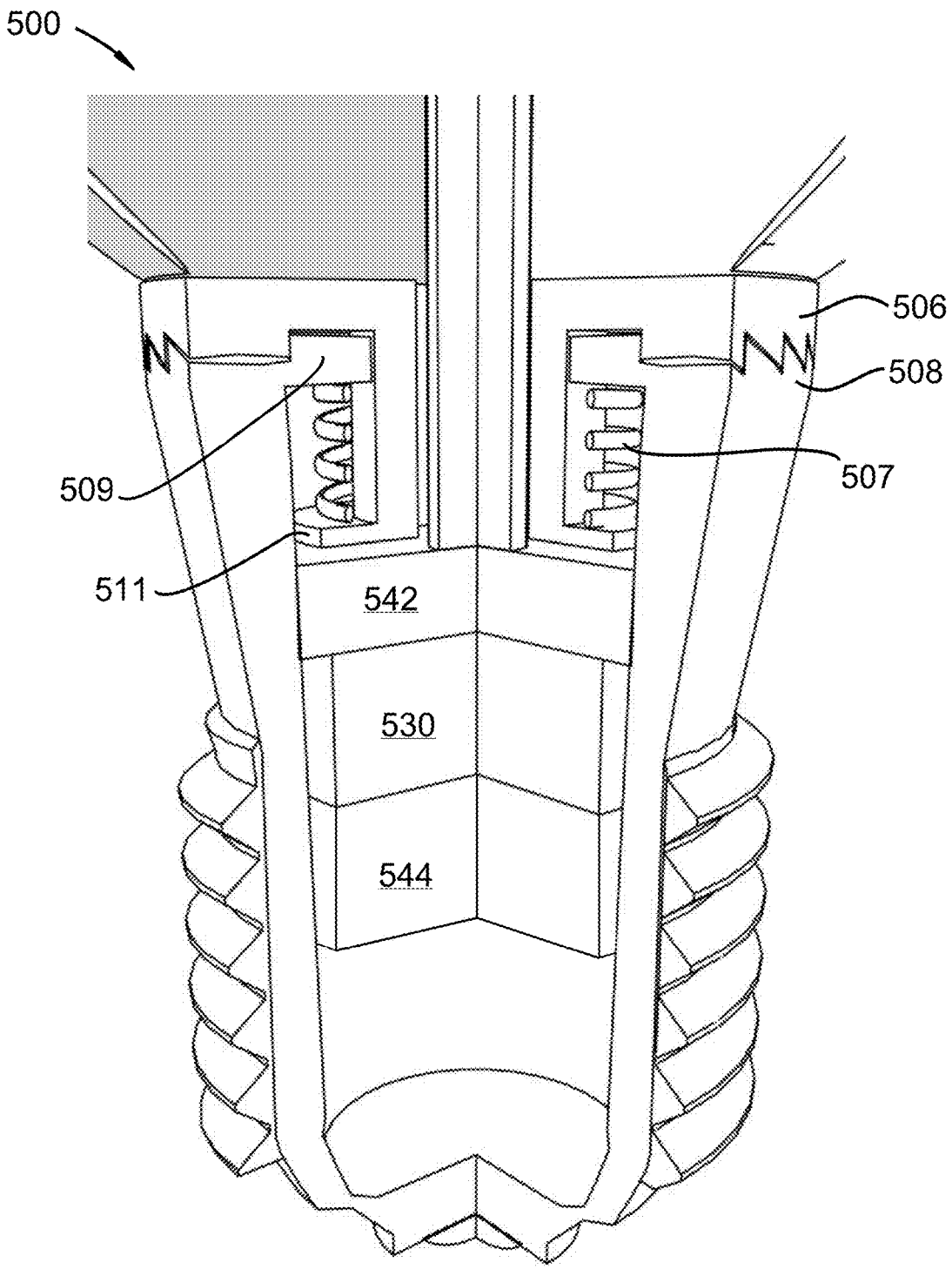
FIG. 5 depicts a cut out section view of a light bulb.

FIG. 5 depicts a cut out section view of a light bulb. Light bulb 500 may include a fixed lower end stop 542, first spring push surface 509, second spring push surface 511, spring 507, first gear 506, and second gear 508. Spring 507 may be concentric with first spring push surface 509, second spring push surface 511, first gear 506, and second gear 508. Spring 507 may also maintain a force on first push surface 509 which is equal and opposite to a force spring 507 may also maintain on second push surface 511. When first push surface 509 and second push surface 511 move relatively closer together, spring 507 may maintain a stronger force on each such that first gear 506 and second gear 508 may remain relatively close together. Proximity of first gear 506 and second gear 508 may force first gear 506 and second gear 508 to rotate synchronously with a clockwise torque until a predetermined torque is reached. Proximity of first gear 506 and second gear 508 may also force first gear 506 and second gear 508 to rotate synchronously with a counter-clockwise torque before and after a predetermined torque is reached.

Light bulb 500 may also include controller 530 which may enable wireless communications, data processing, and Internet connectivity to light bulb 500. Controller may be electrically connected to one or more light sources within light bulb 500. Light bulb 500 may additionally include power source 544 which may store and supply power to controller 530. Power source 544 may be a capacitor, a battery, an electrical line, etc.

Figure 6:
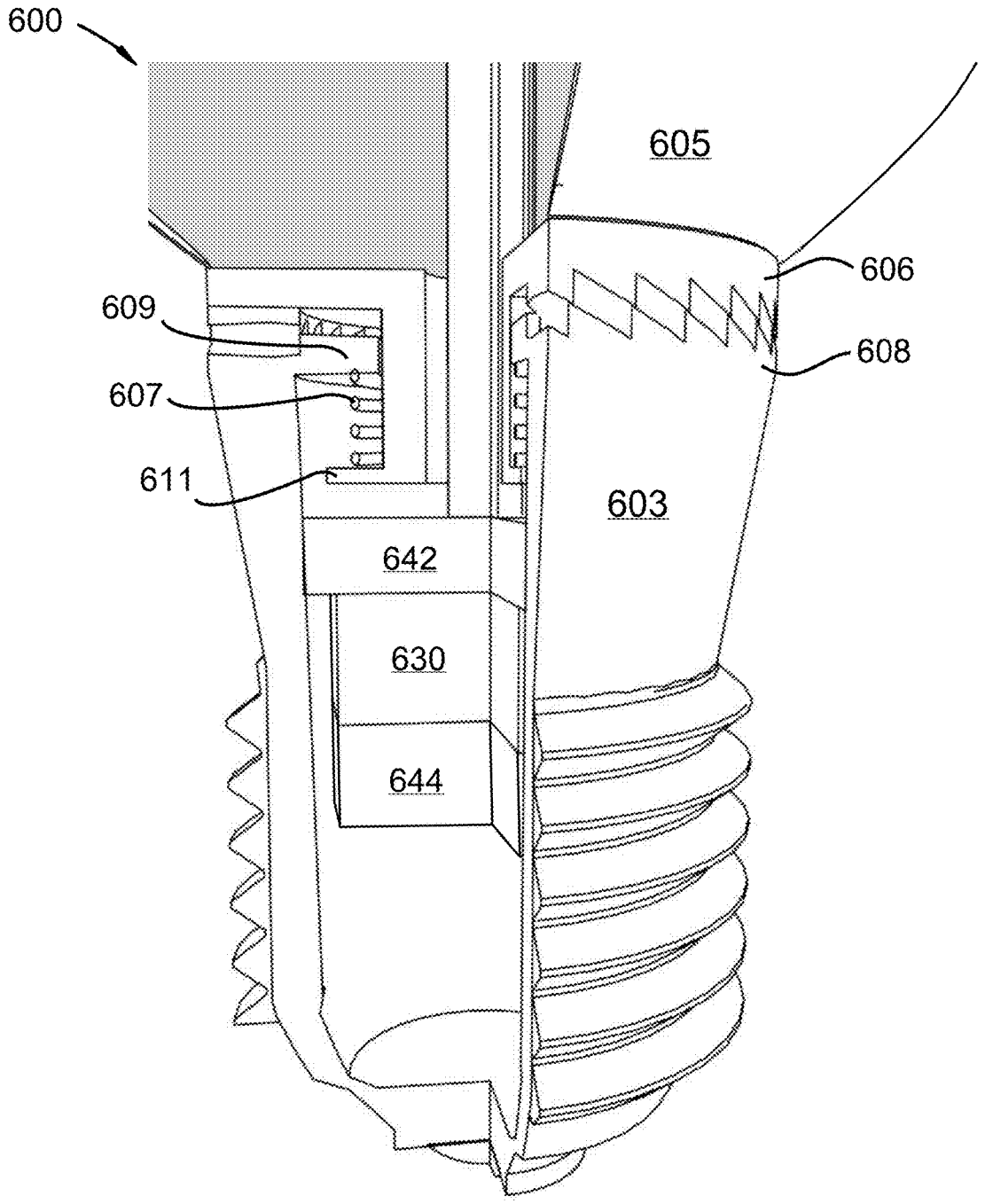
FIG. 6 depicts an embodiment similar to FIG. 5 with parts of a light bulb moved to different positions.

FIG. 6 depicts an embodiment similar to FIG. 5 with parts of a light bulb moved to different positions. Light bulb 600 may include first gear 606, second gear 608, light transmitting bulb portion 605, base portion 603, spring 607, first spring push surface 609, and second spring push surface 611. Light transmitting bulb portion 605 may be pulled away from base portion 603 to disengage first gear 606 from second gear 608, as shown. Compressed spring 607 may, simultaneously, maintain and increase a force on first spring push surface 609 and maintain and increase a force which may be equal and opposite on second spring push surface 611. If light transmitting bulb portion 605 is released from being pulled, in a compressed position, spring 607 may maintain a force between first gear 606 and second gear 608 such that a relatively larger frictional force may be applied between surfaces of first gear 606 and second gear 608 than may have been present before pulling light transmitting bulb portion away from base portion 603. Additionally, if light transmitting bulb portion 605 is released from being pulled, meshed teeth between first gear 606 and second gear 608 may reengage. Spring 607 may subsequently push light transmitting bulb portion 605 toward base portion 603.

LED light sources (not shown) may be included in light transmitting bulb portion. Light transmitting bulb portion 605 may be rotatable while light bulb 600 is turned "on" without rotating the one or more LED light sources or any other light sources. When bulb portion 605 reaches a predetermined rotational torque, bulb portion 605 may be rotated in a clock-wise direction allowing an aperture to be directed in any rotational direction within a 360-degree radius around light bulb 600.

Figure 7:
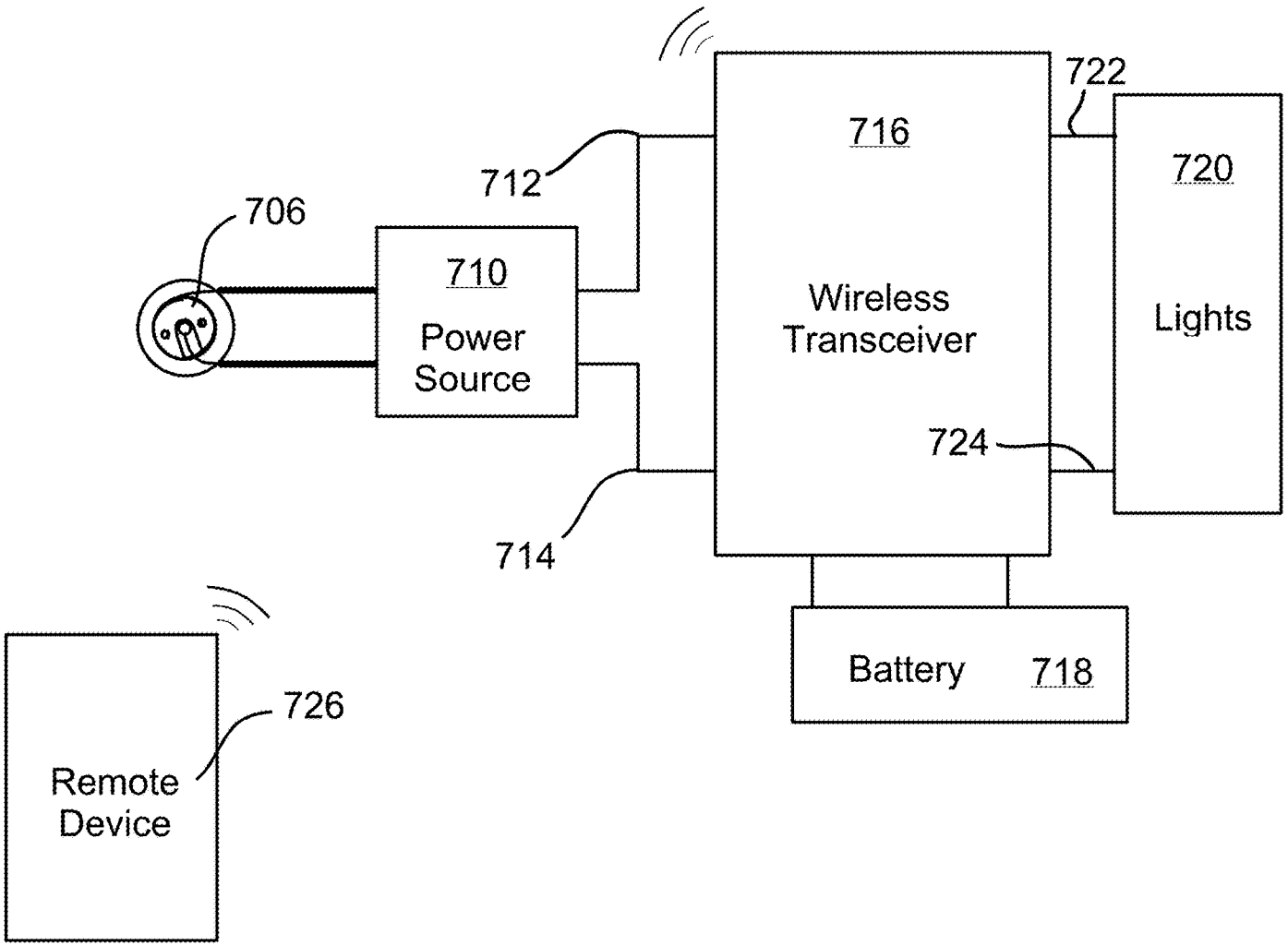
FIG. 7 depicts a schematic diagram in accordance with an embodiment of the invention.

FIG. 7 depicts a schematic diagram in accordance with an embodiment of the invention, wherein components 710-724 are contained in a light bulb base portion 300 as shown in FIG. 3. In some embodiments, light sources 720 may be electrically coupled to controller 716 by two or more wires 722 and 724, Wires 722 and 724 may be duplicated for each light source of light sources 720. That is each light source of light source 720 may include one or more individual wires connecting to controller 716 enabling individual control of each light source by controller 716. Power supply 710 may contain a power transformer, regular, rectifiers, capacitors, etc. needed for suppling power to controller 716. Battery 718 may be a rechargeable battery which supplies either primary or secondary power to light sources 720 and wireless transceiver 716 by way of controller 716. Battery 718 may be recharged based on programming in memory of controller 716. Programming may direct controller to charge battery 716 based on a state-of-charge of battery 718. Wireless transceiver 716 may be coupled to battery 718 to power it when power source when other power sources 706 are not available. In some embodiments, wireless transceiver may charge battery 718 with power obtained via power supply 710. Wireless transceiver 716 may include a controller. The controller may use power from power source 710 and battery 718 to turn "on" lights 720 by way of one or more light wires 722.

Remote device 726 may include user devices such as smart phones, iPads, iPods, laptops, tablets, and computers; other remote devices may include Internet routers, Internet bridges, Internet switches, remote database servers, remote websites, and remote networks.

Figure 8:
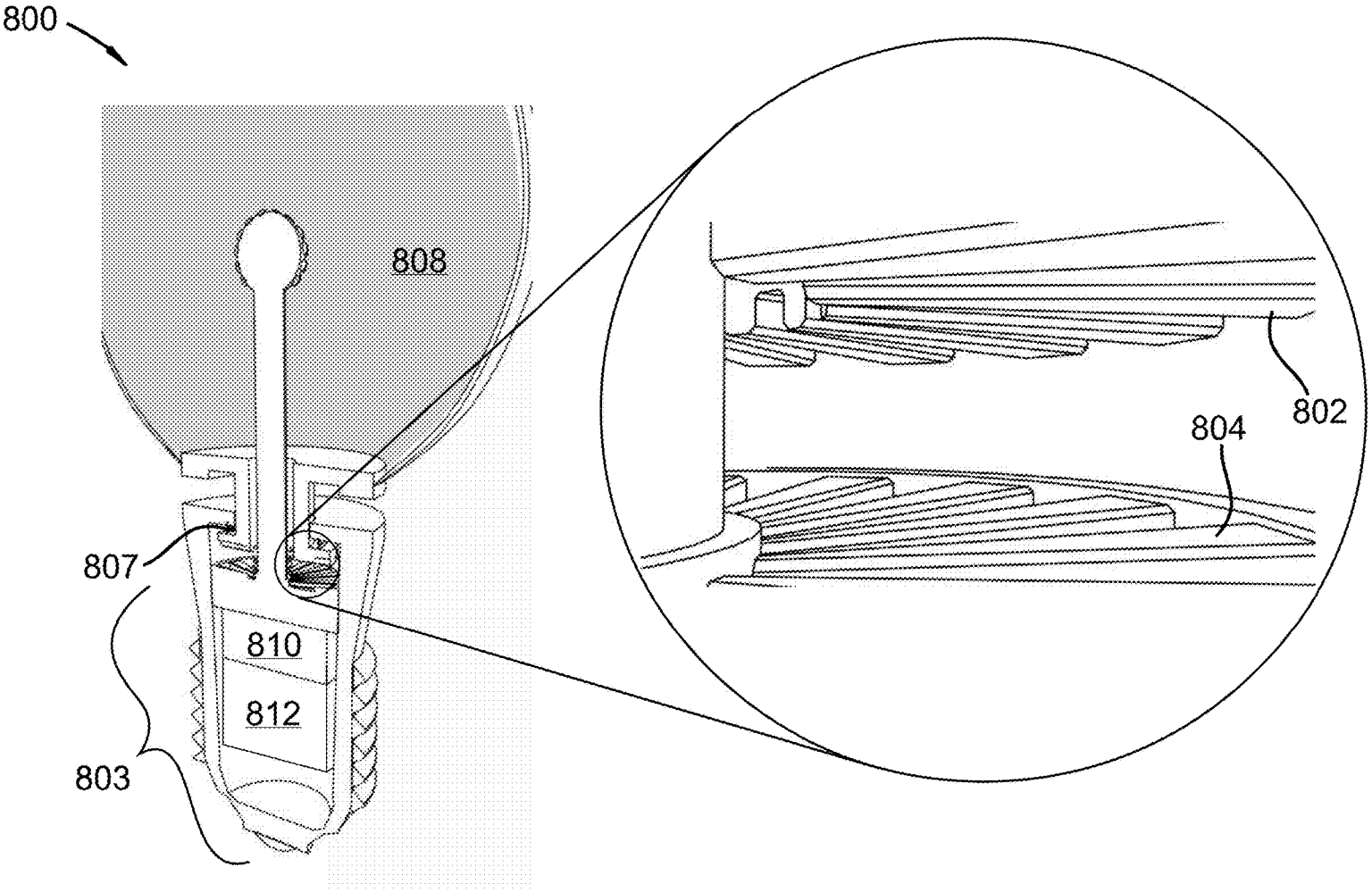
FIG. 8 depicts an embodiment of a light bulb in accordance with the invention.

FIG. 8 depicts a magnified perspective view of internal gears. Light bulb 800 may include spring 803, second push surface 806, first internal gear 802, second internal gear 804, and light transmitting bulb portion 808. First gear 802 may be integral to a first push surface, and second gear 804 may be integral to second push surface 806. Gear 802 and gear 804 may be pushed together by forces maintained by spring 807. While gear 802 and gear 804 are meshed together, light transmitting bulb portion 808 may rotate synchronously with base portion 803 in a clockwise direction or in a counter-clockwise direction before and after a predetermined torque is reached. If gear 802 is pulled away from gear 804, light transmitting bulb portion 808 may rotate independently of base portion 803 in a clockwise or in a counterclockwise direction, until gear 802 is released. Spring 807 may restore gear 802 and gear 804 to a meshing position. Controller 810 and battery 812 may enable a user and/or embedded programming to control light bulb 800.

Figure 9:
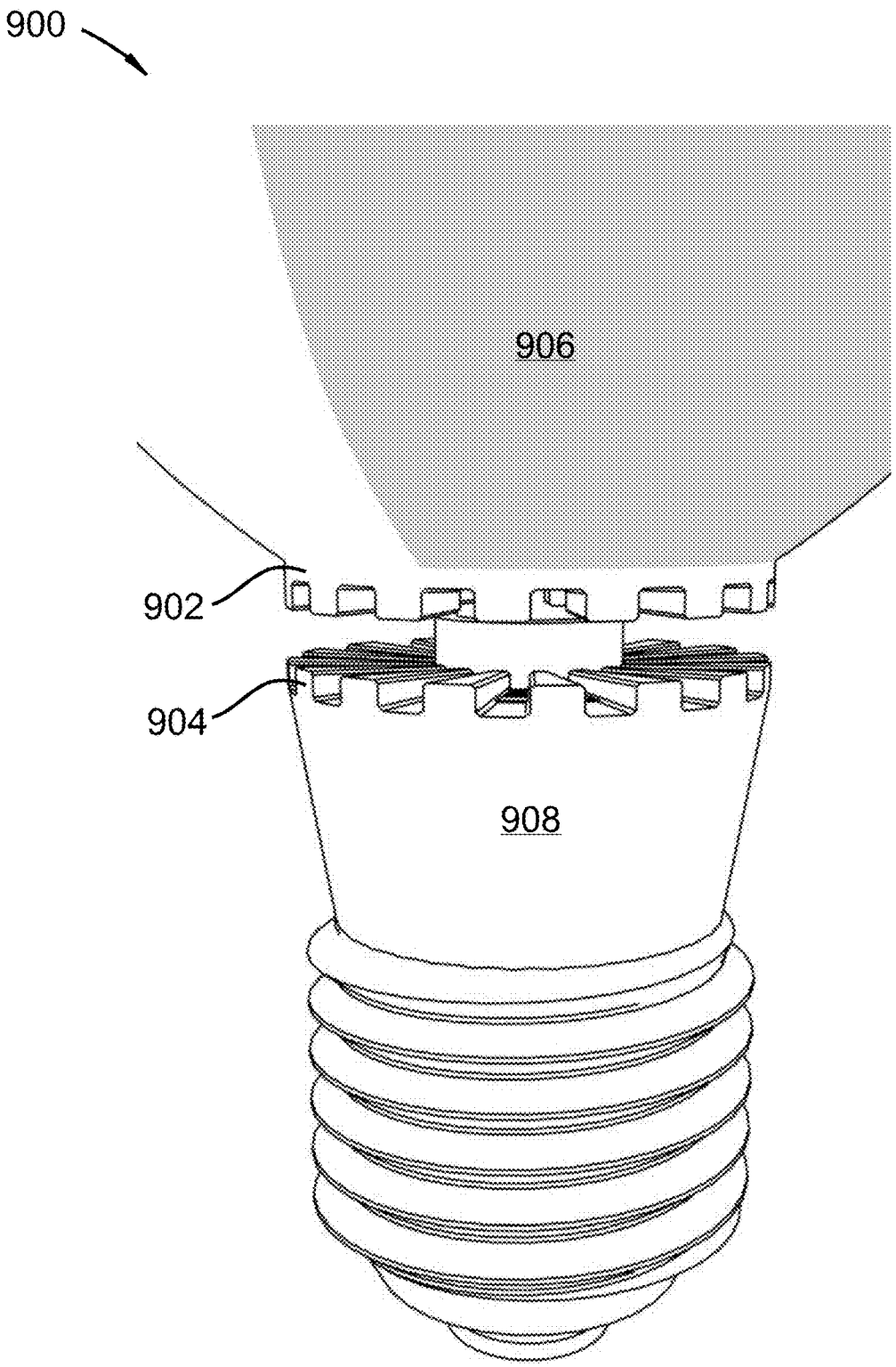
FIG. 9 depicts a side view of a light bulb assembly.

FIG. 9 depicts a side view of a light bulb assembly. Light bulb 900 may include a light transmitting bulb portion 906 and a base portion 908. While first gear 902 and second gear 904 are meshed together, light transmitting bulb portion 906 may rotate synchronously with base portion 908 in a clockwise direction or in a counter-clockwise direction before and after a predetermined torque is reached. If first gear 902 is pulled away from second gear 904, light transmitting bulb portion 906 may rotate independently of base portion 908 in a clockwise or in a counterclockwise direction, until gear 802 is released. A spring may be included to restore first gear 902 and second gear 904 to a meshing position. Light transmitting bulb portion 906 is shown in a removed position in relation to base portion 908. Light transmitting bulb portion 906, while in a removed position, can be rotated independently form base portion 908 and light directed through light transmitting portion 906 can be rotationally directed in a 360-degree movement according to an aperture in the light transmitting bulb portion 906.

Figure 10:
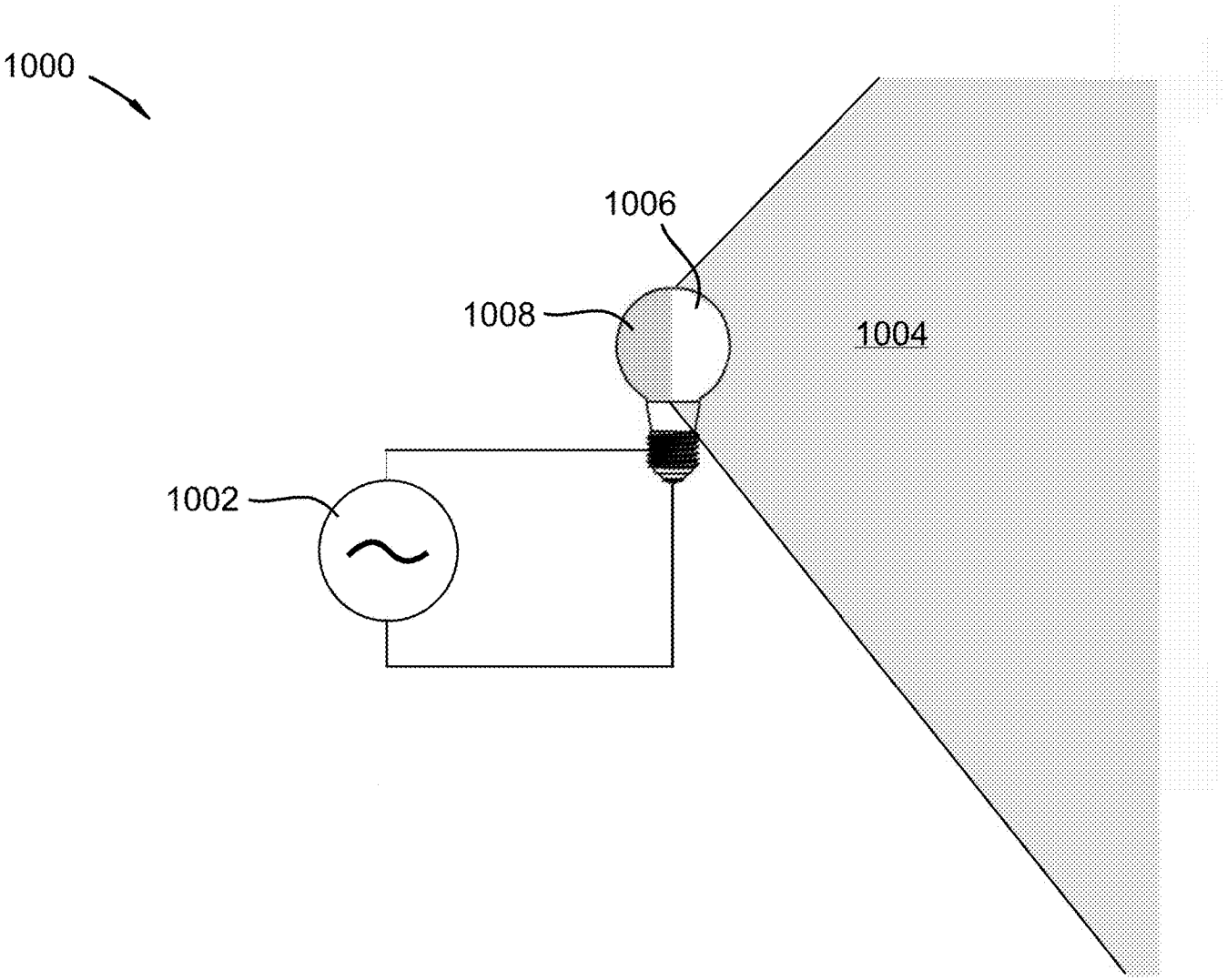
FIG. 10 depicts an electrical power source connected to a light bulb.

FIG. 10 depicts an electrical power source connected to a light bulb. Electrical system 1000 may include power source 1002 which is connected to a light bulb. The light bulb may have masked portion 1008 and aperture 1006. Aperture 1006 allows light 1004 to pass through it. Masked portion 1008 may block light 1004 and may also redirect or reflect light 1004 that impinges on an inner surface inside masked portion 1008 such that nearly all light 1004 may be directed out of aperture 1006. In some embodiments, masked portion 1008 is made of a material which reflects heat as well as light on an inner surface while absorbing heat on an outer surface. Light aperture 1006 may be rotated to direct light 1004 in a 360-degree rotation around the light bulb while the light bulb is installed and while the light is on.

The invention claimed is:

1. A light bulb comprising:

a light source;

a light transmitting bulb portion around the light source comprising a first gear and an aperture, wherein the light transmitting bulb portion comprises an inner surface comprising a light reflecting portion to direct light from the light source toward and out of the aperture; and a base portion comprising a second gear, wherein the first gear rotates synchronously with the second gear until a predetermined torque is reached, and wherein the first gear rotates independently of the second gear once the predetermined torque is reached, such that once the predetermined torque is reached the transmitting bulb portion is rotatable to direct light produced by the light bulb in a direction defined by a rotational position of the aperture of the light transmitting bulb portion.

2. The light bulb of claim 1, wherein the base portion comprises an Edison screw.

3. The light bulb of claim 1, wherein the light transmitting bulb portion rotates synchronously with the base portion in a counter-clockwise direction before and after the predetermined torque is reached.

4. The light bulb of claim 1, wherein the light transmitting bulb portion further comprises a light reflecting portion on an inner surface of the light transmitting bulb portion.

5. The light bulb of claim 4, wherein the light reflecting portion is substantially parabolic in shape.

6. The light bulb of claim 5, wherein the substantially parabolic shape forms a parabolic reflector which comprises more than 40% of an inner surface of the light transmitting bulb portion.

7. The light bulb of claim 1, further comprising one or more light sources.

8. The light bulb of claim 7, wherein one or more light sources are LED (light emitting diode) light sources.

9. The light bulb of claim 8, wherein the LED light sources transmit light through the aperture in the light transmitting bulb portion.

10. The light bulb of claim 7, wherein light transmitted from the one or more LED light sources is transmitted through the light transmitting bulb portion of the light bulb when the light bulb is "on".

11. The light bulb of claim 7, wherein the light transmitting bulb portion is pulled away from the base portion to disengage the first gear from the second gear.

12. The light bulb of claim 11, wherein the light transmitting bulb portion is rotatable while the light bulb is turned "on" without rotating the one or more LED light sources.

13. The light bulb of claim 11, further comprising a spring.

14. The light bulb of claim 13, wherein the spring pushes the light transmitting bulb portion toward the base portion.

15. The light bulb of claim 7, wherein the one or more light sources are induction light sources.

16. The light bulb of claim 7, further comprising a controller and a power supply operably connected to the one or more light sources.

17. The light bulb of claim 16, wherein the controller comprises a processor, memory, and one or more transceivers.

18. The light bulb of claim 1, wherein the first gear and the second gear interlock to screw the base portion into a light socket.

19. The light bulb of claim 1, wherein the first gear and the second gear interlock to unscrew the base portion out of a light socket.

* * * * *